United States Patent [19]

Zimmerman et al.

[11] Patent Number: 4,810,263

[45] Date of Patent: Mar. 7, 1989

[54] FUEL COMPOSITION

[75] Inventors: Abraham A. Zimmerman, Warren; Joseph Vardi, Demarest, both of N.J.

[73] Assignee: Exxon Research and Engineering Company, Florham Park, N.J.

[21] Appl. No.: 81,641

[22] Filed: Aug. 4, 1987

Related U.S. Application Data

[63] Continuation-in-part of Ser. No. 850,812, Apr. 11, 1986, abandoned, which is a continuation-in-part of Ser. No. 823,676, Jan. 29, 1986, abandoned.

[51] Int. Cl.[4] ..... C10L 1/22

[52] U.S. Cl. ..... 44/72; 44/62

[58] Field of Search ..... 44/62, 72

[56] References Cited

U.S. PATENT DOCUMENTS

| | | | |
|---|---|---|---|
| 3,007,784 | 11/1961 | Ebner | 44/72 |
| 3,035,907 | 5/1962 | Halter et al. | 44/72 |
| 3,387,953 | 6/1968 | Bouffard | 44/72 |
| 3,594,139 | 7/1971 | Bouffard | 44/72 |
| 4,209,422 | 6/1980 | Zimmerman et al. | 44/62 |
| 4,356,002 | 10/1982 | Knepper et al. | 44/62 |
| 4,409,000 | 10/1983 | Le Seur | 44/72 |
| 4,478,604 | 10/1984 | Schuettenberg | 44/72 |

*Primary Examiner*—William R. Dixon, Jr.
*Assistant Examiner*—Jerry D. Johnson
*Attorney, Agent, or Firm*—Roy J. Ott

[57] ABSTRACT

An additive package for reducing and/or preventing injector fouling in a multiport fuel injection means is described. The additive package preferably comprises a particularly described amine oxide, one or more particularly described demulsifiers, and a particularly described solvent system.

18 Claims, No Drawings

FUEL COMPOSITION

CROSS REFERENCE TO RELATED APPLICATION

This application is a Continuation-in-Part of U.S. patent application Ser. No. 850,812, filed Apr. 11, 1986, now abandoned, which is a Continuation-in-Part of U.S. patent application Ser. No. 823,676, filed Jan. 29, 1986, now abandoned.

BACKGROUND OF THE INVENTION

This invention is directed to an antifouling fuel composition. More specifically, the present invention is directed at a fuel composition having particular applicability in minimizing and/or preventing injector fouling in gasoline engines equipped with electronically controlled multiport fuel injectors.

Over the past several years, improvements have been made in the performance of internal combustion engines. One of the most significant improvements which has been made has been the widespread use of fuel injection to improve the performance and fuel economy of internal combustion engines. While carburetor-equipped internal combustion engines admix the air and fuel for distribution through a manifold to all of the cylinders, in a fuel injected engine the fuel is injected into the manifold close to the intake valve of each cylinder for combustion. Fuel injection systems are of two basic types, mechanically controlled and electronically controlled. The early fuel injected engines were controlled mechanically, i.e., the operation of each injector was controlled by pressure. Recently, however, the use of electronically controlled fuel injection engines has become increasingly widespread. In an electronically controlled fuel injection system sensors disposed in the exhaust are employed to maintain the air to fuel ratio within narrow limits. Electronically controlled fuel injection systems offer the same performance and fuel economy benefits that would be achieved with mechanically controlled fuel injection systems and also serve to more closely regulate fuel-air mixtures to thereby enable the catalytic converter to oxidize carbon monoxide and hydrocarbons to carbon dioxide and simultaneously to reduce nitrogen oxides and thus meet emissions control legislation. Such legislation imposing as it did strict control of exhaust pollutants ultimately led to the development and widespread application of new technologies such as electronic fuel injection.

It has been found that the electronically controlled fuel injector systems have small port openings which are prone to fouling by deposits. These deposits are believed to occur, at least in part, by gasoline and oil vapor, which is present in close proximity to the injector tip, becoming baked onto the hot surfaces of the injector pintle and on the surfaces of the annulus surrounding the pintle when the engine is shut off. These deposits restrict the fuel flow to that particular cylinder. This, in turn, causes a sensor disposed in the exhaust to detect a higher than desired oxygen to fuel ratio. The sensor will attempt to correct this condition by increasing the amount of fuel injected into all of the cylinders. This, in turn, will result in a richer than desired fuel to air ratio in the exhaust. The sensor then will attempt to correct this by decreasing the amount of fuel injected into each cylinder. This cyclical adjustment of the fuel to air ratio ranging between too lean a mixture and too rich a mixture can at times result in poor operating performance of the vehicle. In addition, close tolerances in this new type of injector and concurrently higher underhood temperature also tend to enhance deposit formation resulting in poor vehicle driveability and exhaust pollutant emission levels which exceed the maximum levels set by emissions control legislation.

It has been found that conventional gasoline detergents, which have proven effective in preventing and/or eliminating carburetor deposits are not particularly effective in removing and/or preventing deposit build-up that may occur in electronically controlled fuel injection systems. Presently available methods for removing deposits from fuel injector orifices typically comprise either mechanically cleaning the injectors or the addition to the fuel of relatively large quantities of particular additives. Mechanical cleaning, which may involve either the complete removal of the injector for manual deposit removal or the use of polar solvents for flushing the deposits free, is not desired because of the relatively high cost and inconvenience. Currently available additives are not particularly desirable because product recommendations indicate they must be used at relatively high concentrations, i.e. about one to about two tons per thousand barrels of fuel.

To be useful commercially a gasoline additive for reducing and/or preventing injector port fouling must be effective at low concentration, must not significantly affect the combustion characteristics of the fuel and must not foul the catalytic converter catalyst.

The additive also should not promote excessive emulsification, and should not promote the formation of two organic phases.

Additives have been added to gasoline to improve certain properties of the fuel. U.S. Pat. No. 3,387,953 is directed at the use of organo-substituted nitrogen oxides, particularly amine oxides for rust inhibition and as anti-icing agents in gasoline. Several representative formulas for amine oxides are given including the following:

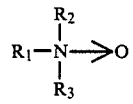

where: $R_1$ is $C_6$–$C_{24}$ alkyl, aryl, cycloaliphatic, heterocyclic, substituted alkyl or substituted aryl; and $R_2$ and $R_3$ are the same or different and are $C_1$–$C_{24}$ alkyl, aryl, substituted alkyl or aryl, cycloaliphatic or heterocylic. $R_2$ and $R_3$ preferably comprise hydroxy substituted alkyls. These compounds typically are added to gasoline in a concentration within the range of about 2.0 to about 100 pounds of amine oxide per 1,000 barrels of gasoline (ptb). Among the most preferred additives is bis(2-hydroxy ethyl) cocoamine oxide.

U.S. Pat. No. 3,594,139 is directed at a rust-inhibitor concentrate that can be blended with gasoline year-round including amine oxides having the aforementioned formula, with a particularly preferred amine oxide comprising bis(2-hydroxy ethyl) cocoamine oxide. The concentrate also comprises a liquid aromatic $C_7$–$C_{10}$ hydrocarbon and an aliphatic monohydric or dihydric alcohol having from about 6 to about 13 carbon atoms. Preferred aromatic hydrocarbons comprise ortho, meta and mixed xylenes. Preferred aliphatic alcohols comprise $C_6$–$C_{13}$ oxo alcohols. The examples disclose the combination of xylene, bis(2 hydroxyethyl) cocoamine oxide, and $C_8$ oxo alcohols.

The amine oxides described above have been typically used to inhibit rust and carburetor icing. While these compounds were used commercially during the late 1960's and early 1970's, their use in the United States was discontinued as more effective additives were found. The use of these compounds had been discontinued in the United States well before the development of electronically controlled, fuel injected engines.

It has been discovered that use of amine oxides at concentrations generally higher than that which previously had been used for rust inhibition would be effective in preventing and/or reducing injector fouling in multiport fuel injected engines. However, when amine oxides are used at these higher concentrations they tend to act as emulsifiers which bring into the gasoline layer, water, sediment and impurities which may have entered the product distribution system. This prevents normal separation of the gasoline from any water or normally insoluble impurities. The admixture of these impurities is not desired with the gasoline, since this would result in excessive fuel filter fouling and in poor vehicle operation. In addition, it is believed that formation of an emulsion results in undesirable concentration of the amine oxide additive at the interface. It also has been found that the use of certain solvents to produce an additive concentrate having low cloud and pour points may form two organic layers, resulting in uneven additive distribution.

Accordingly, it would be desirable to provide an additive package for gasoline which will be effective in reducing and/or eliminating fouling without forming an emulsion with water bottoms and interfacial solids.

It also would be desirable to provide an additive package having a demulsifying agent which is effective in the presence of both neutral and basic waters.

It also would be desirable to provide an additive concentrate which has low cloud and pour points and which does not result in the formation of more than one organic layer.

Accordingly, it would be desirable to provide a gasoline additive package which is relatively inexpensive and effective at low concentrations to reduce and/or eliminate injector fouling.

It also would be desirable to provide a gasoline additive package which is non-corrosive, non-deleterious to the catalyst, and does not effect the combustion characteristics of the fuel.

It also would be desirable to provide a gasoline additive package which could be easily added to the finished gasoline at any point during the storage and/or distribution system.

SUMMARY OF THE INVENTION

The present invention is directed at a fuel composition for minimizing and/or preventing injector fouling in a multiport electronically controlled fuel injected engine. The composition comprises:

A. gasoline

B. an anti-fouling agent having the formula:

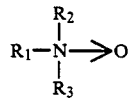

where: $R_1$ is $C_6$–$C_{24}$ alkyl, aryl, cycloaliphatic, heterocyclic, substituted alkyl or substituted aryl; and $R_2$ and $R_3$ independently are $C_1$–$C_{24}$ alkyl, aryl, substituted alkyl or aryl, cycloaliphatic or heterocyclic; and, C. a demulsifier comprising one or more of the following demulsifying agents:

i. a fatty acid alkylamine reaction product; and, ii. a solution of oxyalkylated alkyl phenol formaldehyde resins and polyglycols.

In this composition $R_1$ preferably is $C_6$–$C_{20}$ alkyl, or alkylated aryl, and $R_2$ and $R_3$ independently are $C_1$–$C_{12}$ hydroxy substituted alkyl. In a more preferred composition $R_1$, comprises $C_8$–$C_{18}$ substituents derived from fatty acid. The additive preferably is selected from the group consisting of bis(2-hydroxy ethyl) cocoamine oxide, bis(2-hydroxy ethyl) tallow amine oxide, bis(2-hydroxy ethyl) stearyl-amine oxide, dimethylcocoamine oxide, dimethyl hydrogenated tallow amine oxide, dimethylhexadecylamine oxide and mixtures thereof. A particularly preferred additive is bis(2-hydroxy ethyl) cocoamine oxide. The anti-fouling agent concentration in the fuel typically may range between about 0.5 and about 50 ptb (i.e. about 2 to about 200 ppm, by weight), preferably between about 5 and about 15 ptb (i.e. about 20 to about 60 ppm).

In demulsifying agent (ii) the oxyalkylated compounds preferably comprise ethylene oxide and propylene oxide copolymers. The active concentration of the demulsifying agent may range between about 0.025 and about 10 ptb (about 0.1 and about 40 ppm), preferably between about 0.25 and about 2.0 ptb (about 1.0 and 8.0 ppm).

A fuel composition may comprise:

A. about 2 to about 200 ppm bis(2-hydroxy ethyl) cocoamine oxide; and,

B. about 0.1 to about 40 ppm of a demulsifying agent selected from the group consisting of:

i. fatty acid alkylamine reaction product;

ii. a solution of oxyalkylated alkylphenol formaldehyde resins and polyglycols; and mixtures of i and ii.

A preferred composition comprises:

A. about 20 to about 60 ppm bis(2-hydroxy ethyl) cocoamine oxide; and,

B. about 1 to about 8 ppm of a demulsifying agent selected from the group consisting of:

i. fatty acid alkylamine reaction product;

ii. a solution of oxyalkylated alkylphenol formaldehyde resins and polyglycols; and mixtures of i and ii.

A preferred fuel composition includes an additive package comprising:

A. about 20 ppm to about 60 ppm bis(2-hydroxy ethyl) cocoamine oxide;

B. about 0.5 ppm to about 4 ppm fatty acid alkylamine reaction product; and,

C. about 0.5 ppm to about 4 ppm of a solution of oxyalkylated alkylphenol formaldehyde resins and polyglycols.

The present invention also is directed at a fuel additive concentrate for internal combustion engines, said additive concentrate comprising:

A. about 5 to about 50 wt. % bis(2-hydroxy ethyl) cocoamine oxide;

B. about 0.25 to about 10 wt. % of a demulsifying agent selected from the group consisting of:

i. fatty acid alkylamine reaction product;

ii. a solution of oxyalkylated alkylphenol formaldehyde resins and polyglycols; and mixtures of i and ii; and, C. about 40 to about 95 wt. % solvent.

The solvent preferably comprises xylene and a $C_4$+ alcohol, preferably a $C_4$–$C_{12}$ alcohol, more preferably a $C_8$ alcohol and most preferably a $C_8$ oxo alcohol. Where the ratio of the concentration of water relative to amine oxide exceeds about 0.05, a highly water and hydrocarbon soluble alcohol, preferably isopropanol, also should be added.

DETAILED DESCRIPTION OF THE INVENTION

The present invention is directed at a fuel composition and a gasoline additive package which has been found to be particularly effective in reducing and/or eliminating injector fouling. The present invention is directed at a fuel comprising:

A. gasoline;

B. an anti-fouling agent having the following structural formula:

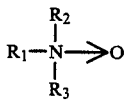

where $R_1$ is $C_6$–$C_{24}$ alkyl, aryl, cycloaliphatic, heterocyclic, substituted alkyl, substituted aryl; $R_2$ and $R_3$ independently are $C_1$–$C_{24}$ alkyl, aryl, substituted alkyl or aryl, cycloaliphatic, heterocyclic, and mixtures thereof; and, C. a demulsifying agent selected from the group consisting of:

i. a fatty acid alkylamine reaction product;

ii. a solution of an oxyalkylated alkylphenol formaldehyde resins and polyglycols; and mixtures thereof.

Preferred anti-fouling agents include compounds wherein: $R_1$ is $C_6$–$C_{20}$ alkyl, or alkylated aryl; and $R_2$ and $R_3$ independently are hydroxy substituted $C_1$–$C_{12}$ alkyl. Particularly preferred compounds are compounds wherein $R_1$ comprises a $C_8$–$C_{18}$ substituent. The additive preferably is selected from the group consisting of bis (2-hydroxy ethyl) cocoamine oxide, bis(2-hydroxy ethyl) stearylamine oxide dimethylcocomine oxide, dimethyl hydrogenated tallow amine oxide, dimethylhexadecylamine oxide and mixtures thereof. These additives are prepared in accordance with known techniques, such as disclosed in U.S. Pat. No. 3,387,953, the disclosure of which is incorporated herein by reference. A particularly preferred anti-fouling agent is bis(2-hydroxy ethyl) cocoamine oxide.

The following Comparative Examples and Examples demonstrate the utility of the anti-fouling agent in reducing and/or eliminating fuel injector fouling. In the following Comparative Examples and Examples, the octane rating of the fuel utilized is the posted octane rating which is defined as:

$$\frac{\text{Research Octane} + \text{Motor Octane}}{2}$$

COMPARATIVE EXAMPLE I

In this test three 1985 Oldsmobile 98's having electronically controlled, fuel injected, 3.8 liter, six cylinder engines were driven on a commercial, unleaded, 87 octane reference fuel having a detergent concentration of 8.5 ptb for approximately 3500 miles under the following driving cycle: 0.5 hours city-type driving, 0.5 hour engine off, 0.5 hour highway driving, 0.5 hour engine off. Driveability on all four vehicles became poor to very poor. The vehicles then were driven for 300 miles with a commercial premium grade 92 octane unleaded fuel containing 2.5 times the detergent used in the above reference fuel. Driveability remained unchanged. The data in Table I below show that there was still a marked reduction in fuel flow indicating that a high level of deposit was unaffected by the detergent even at the high treat rate. The percent fuel flow reduction was determined by measuring the volume of a mineral spirit that flowed through the injector under predetermined standardized conditions, including fuel pressure, pulse width and duty cycle. The percent reduction is calculated using the formula:

$$\% \text{ Reduction} = \frac{V_{clean} - V_{dirty}}{V_{clean}} \times 100\%$$

where $V_{clean}$ and $V_{dirty}$ are the measured volumes of mineral spirit passed through the clean and dirty fuel injectors.

TABLE I

% FLOW REDUCTION THROUGH INJECTOR PORTS

| | Cyl # | | | | | |
|---|---|---|---|---|---|---|
| | 1 | 2 | 3 | 4 | 5 | 6 |
| Car A | 11 | 12 | 35 | 30 | 7 | 10 |
| Car B | 7 | 9 | 12 | 38 | 9 | 14 |
| Car C | 22 | 11 | 28 | 4 | 11 | 10 |
| Typical New Injectors | 2 | 2 | 0 | 0 | 2 | 1 |

From Table I it can be seen that this conventional, known carburetor detergent was ineffective in removing deposits from injector ports and in fact permitted deposits to form.

COMPARATIVE EXAMPLE II

A 1985 Chrysler LeBaron equipped with a 2.2 liter turbocharged engine having electronically controlled fuel injection was driven for 1300 miles on a mileage accumulation dynamometer using a typical regular grade, 87 octane, unleaded, detergent-free gasoline. The driving was based on repetition of the following cycle: 30 minutes city driving, 30 minutes engine off, 30 minutes highway driving, 30 minutes engine off. The driveability became very poor as typified by rough idle and severe hesitation. The hydrocarbon emissions measured before the catalytic converter were 321 ppm at engine idle. The injector fouling was measured using a pressure differential test. In this test the fuel rail is pressurized to 49 psig and an injector is pulsed for 0.5 seconds. The pressure drop, or leakdown P, is indicative of how readily the fuel flows, i.e., the higher the number, the less the injector is obstructed. In this vehicle the pressure differential for a clean injector under these conditions is 19–22 psig. This data is set forth below in Table II.

EXAMPLE I

Following the test set forth in Comparative Example II, the vehicle was refueled with the same fuel except that the fuel also contained 10 ptb of bis(2-hydroxy ethyl) cocoamine oxide (HECO). The vehicle then was driven on the following cycle: 15 minutes city driving, 30 minutes highway driving, 15 minutes city driving, 2 hours engine off. This test continued until 270 miles were accumulated on the vehicle. At the end of this test period the driveability was very good. The hydrocarbon emissions at idle before the catalytic converter were reduced to 200 ppm. The percent injector flow reduction and the pressure differential were significantly improved as set forth in Table II.

From the data of Example I and Table II it can be seen that the use of a relatively low concentration of HECO was able to produce a significant improvement in driveability. The idle emissions were significantly reduced and the pressure differential and percent flow reduction of the flow injectors were returned to "as new" conditions after a relatively few miles of driving.

TABLE II

| PORT INJECTOR FOULING | | | | | | | | | |
|---|---|---|---|---|---|---|---|---|---|
| HECO ADDITIVE CONCENTRATION (ptb) | MILES DRIVEN | % INJECTOR FLOW REDUCTION INJECTOR NO. 1 | 2 | 3 | 4 | LEAKDOWN P INJECTOR NO. 1 | 2 | 3 | 4 |
| None | 1300 | Not run* | | | | 13 | 13 | 13 | 12 |
| 10 | 270 | 0 | 1 | 0 | 0 | 19 | 19 | 19 | 19 |

*Test not run to avoid disturbing deposit formation before end of test.

As shown by the following Comparative Examples and Example, bis (2-hydroxy ethyl) cocoamine oxide also was effective in preventing the build-up of fuel injector tip deposits.

COMPARATIVE EXAMPLE III

In this Comparative Example, four 1985 Chrysler LeBarons equipped with four cylinder, electronically controlled, fuel injected, turbocharged, 2.2 liter engines were driven on mileage accumulation dynamometers under the following conditions: 0.5 hour city-type driving, 0.5 hour engine off, 0.5 hour highway type driving and 0.5 hour engine off for 4,000 miles. The control cars ran on a regular grade, 87 octane, detergent-free, unleaded fuel. Following the test, the percent flow reduction was measured using the procedures previously set forth hereinabove. The tests were repeated in four different runs (same make and model). The results of these tests are set forth in Table III below.

EXAMPLE II

A 1985 Chrysler LeBaron, similar to that set forth in Comparative Example III was used in this test which was conducted under the same conditions set forth in that Comparative Example. The gasoline used during this test was the same as that used in the control cars, but with the further addition of 10 ptb of bis-(2-hydroxy ethyl) cocoamine oxide (HECO). The results of these tests are also set forth in Table III below. From a review of these tests it can be seen that the addition of a relatively low concentration of HECO was able to prevent a significant reduction in the fuel injector flow rate.

TABLE III

| HECO ADDITION PREVENTS SIGNIFICANT INJECTOR PORT FOULING | | | | | | | | |
|---|---|---|---|---|---|---|---|---|
| | Initial Test | | | | | | Repeat Test | |
| | | % Flow Reduction | | | | | | Avg. % |
| | Driveability | #1 | #2 | #3 | #4 | Avg. | Driveability | Flow Reduction |
| Comp. Example III | | | | | | | | |
| Control Car No. | | | | | | | | |
| 1 | Undriveable | 35 | 25 | 24 | 24 | 24 | Undriveable | 26 |
| 2 | Undriveable | 39 | 13 | 14 | 16 | 20 | Undriveable | 19 |
| 3 | No problems | 13 | 23 | 13 | 14 | 16 | Undriveable | 19 |
| 4 | Undriveable | 3 | 21 | 11 | 14 | 12 | Undriveable | 11 |
| Example II | | | | | | | | |
| Car with HECO in fuel | No problems | 0 | 0 | 0 | 0 | 0 | No problems | <1.0* |

*Car run 5,000 miles

COMPARATIVE EXAMPLE IV

In this test a 1985 Chrysler LeBaron having a four cylinder, turbocharged, 2.2 liter engine with electronically controlled fuel injection was operated for 2,002 miles on a mileage accumulation dynamometer simulating alternating driving and engine-off cycles. The fuel utilized was typical of a regular grade, 87 octane, unleaded fuel containing 8.5 ptb of the same detergent used in Comparative Example I. Following the completion of this test, the percent flow reduction through the fuel injector ports was measured by the method previously described herein. As shown in Table IV below the use of this conventional carburetor detergent was ineffective in preventing injector fouling.

EXAMPLE III

A vehicle similar to that utilized in Comparative Example IV was utilized in this Example under the same operating conditions. The fuel utilized was similar but with the replacement of the conventional carburetor detergent by 10 ptb of bis(2-hydroxyl ethyl) cocoamine oxide. The vehicle was driven for 9,600 miles under the same sequence set forth in Comparative Example IV. The bis(2-hydroxy ethyl) cocoamine oxide was able to prevent any significant flow reduction in the fuel injectors as shown by data presented in Table IV.

TABLE IV

COMPARISON OF HECO AND CONVENTIONAL CARBURETOR DETERGENT IN PREVENTING INJECTOR PORT FOULING

| ADDITIVE | CONCENTRATION, ptb | MILES DRIVEN | % FLOW REDUCTION CYL # 1 | 2 | 3 | 4 |
|---|---|---|---|---|---|---|
| Conventional Carburetor Detergent | 8.5 | 2,002 | 4 | 8 | 1 | 16 |
| HECO | 10 | 9,600 | 0 | 1 | 0 | 0 |

From this Table it can be seen that the use of a relatively low concentration of HECO was able to prevent any significant buildup of injector tip deposits. By comparison, the use of a conventional carburetor detergent at approximately the same rate was unable to prevent a relatively rapid deposit build-up of injector tip deposits.

While the data presented above has demonstrated the utility of the anti-fouling agent in gasoline, the anti-fouling agent also may be of utility in other fuels, such as diesel fuel.

While the presently described anti-fouling agent may be used alone, it also may be desirable to utilize the present invention in combination with a demulsifier to facilitate the separation of the gasoline from any foreign substances which may be present in the distribution system, such as water and sediment.

The water, if any, typically has a pH ranging from about 7 to about 12. Thus, a demulsifier for use with the anti-fouling agent preferably should be effective over this pH range. The following Comparative Examples and Examples demonstrate the utility of a demulsifying agent selected from the group consisting of:

A. a fatty acid alkylamine reaction product;

B. a solution of oxyalkylated alkylphenol formaldehyde resins and polyglycols; and mixtures of A and B above.

COMPARATIVE EXAMPLE V

In this Comparative Example the effectiveness of various commercially available demulsifying agents were tested in a 90 wt. % fuel–10 wt. % water system. The fuel contained 10 ptb HECO and 1 ptb of the various additives noted below. The effectiveness of the various demulsifying agents was reached using a Multiple Contact Emulsion Test. In this test 10 ml of distilled water was added to separate half-pint bottles. To each bottle was added 100 ml of gasoline. The bottles were capped, placed on their sides in a mechanical shaker and agitated at approximately 280 cycles per minute for five minutes. The bottles then were placed upright in a dark location and allowed to stand for 24 hours. The mixture then was rated considering the gasoline layer, the water layer and the interface using the rating scale set forth in Table V below. After the ratings were completed, the gasoline level was sucked down to a level about ¼ inch above the emulsion layer without disturbing the interface or water layer. The withdrawn fuel was discarded and 100 ml of fresh gasoline was added to each bottle. The mixture was then shaken and the test repeated for a total of ten times (i.e. a total of about 10 days) or until it became apparent that the emulsion forming tendencies had exceeded acceptable levels of 3 or lower. The trade names of the commercially available additive utilized, the worst ratings of each mixture and the time period before each test was terminated are set forth in Table VI below. A description of additives listed in Table VI is given in Table VII.

TABLE V

RATING SCALE FOR REPORTING EMULSION TEST RESULTS

| RATING | DESCRIPTION OF EMULSION |
|---|---|
| 0 | No skin or interface |
| 1 | Slight skin on interface - not completely continuous |
| 2 | Thicker skin on interface - usually completely continous |
| 3 | Incipient emulsion ⅛ as thick as water layer |
| 4 | Emulsion ¼ as thick as water layer |
| 5 | Emulsion ⅜ as thick as water layer |
| 6 | Emulsion ½ as thick as water layer |
| 7 | Emulsion ⅝ as thick as water layer |
| 8 | Emulsion ¾ as thick as water layer |
| 9 | Emulsion ⅞ as thick as water layer |
| 10 | Emulsion completely filling water layer Emulsion of maximum severity |

TABLE VI

EMULSION TEST RESULTS

| DEMULSIFIER DESCRIPTION | WORST RATING | DAYS RUN |
|---|---|---|
| None | 6 | 10 |
| Tolad | | |
| T-284 | 5 | 4 |
| T-286 | 4 | 3 |
| T-292 | 4–5 | 5 |
| T-347 | 4–5 | 3 |
| T-370 | 5 | 6 |
| T-500 | 3–4 | 6 |
| T-364 | 6 | 4 |
| Nalco | | |
| 5450 | 6 | 3 |
| 5451 | 4 | 5 |
| 5452 | 5 | 5 |
| 5453 | 4 | 6 |
| 5455 | 4–5 | 5 |
| 5RD646 | 6 | 6 |
| 5RD649 | 6 | 6 |
| 5RD651 | 4 | 8 |
| 5RD652 | 6 | 6 |
| 5RD653 | 6 | 6 |
| 5RD654 | 6 | 6 |
| 5 or 6RD871 | 7 | 6 |
| 85BD194 | 4 | 5 |

TABLE VII

DESCRIPTION OF DEMULSIFIERS LISTED IN TABLE VI

| Demulsifier | Description |
|---|---|
| Tolad T-292 | Oxyalkylated alkylphenol formaldehyde resins in aromatic hydrocarbons and isopropanol |
| Tolad T-347 | Oxyalkylated alkylphenol formaldehyde resins and acylated polyglycols in aromatic hydrocarbons and methanol |
| Tolad T-370 | Polyglycols in aromatic hydrocarbons |
| Nalco 5450 | Hydrocarbon blend of alkylphenol formaldehyde resin polyoxyalkylene polyether |
| Nalco 5451 | Polyglycolated polyol esters and polyglycolated alkylphenol/formaldehyde resin in aromatic solvent |
| Nalco 5452 | Polyolpolyethers and oxyalkylated alkylphenol/formaldehyde resin adducts in aromatic solvent |
| Nalco 5453 | Oxyalkylated alkylphenol/formaldehyde resin adducts in aromatic solvent |
| Nalco 85BD-194 | Ethoxylated nonyl phenol/formalde- |

TABLE VII-continued

| DESCRIPTION OF DEMULSIFIERS LISTED IN TABLE VI | |
|---|---|
| Demulsifier | Description |
| | hyde resin in hydrocarbon solvent |

EXAMPLE IV

A gasoline-distilled water sample having 10 ptb of HECO similar to that of Comparative Example V was utilized. However, in place of the demulsifiers listed in Table VI the following additives were used alone or in combination.

Additive A—Nalco 3BD829 Fuel Dehazer, manufactured by Nalco Chemical Company, Oak Brook, Ill., which comprises a fatty acid alkylamine reaction product and methanol in a hydrocarbon solvent.

Additive B—Tolad T-326 manufactured by the Tretolite Division of Petrolite Corporation, St. Louis, Mo. This additive comprises oxyalkylated alkylphenol-formaldehyde resins and polyglycols in aromatic naphtha. The Multiple Contact Emulsion Test previously described was utilized to determine the effectiveness of these demulsifiers. These test results are summarized in Table VIII below.

TABLE VIII

| EMULSION TEST RESULTS | | | |
|---|---|---|---|
| DEMULSIFIER DESCRIPTION | CONCENTRATION | WORST RATING | DAYS RUN |
| Additive A | 1 ptb | 0 | 10 |
| Additive B | 1 ptb | 2 | 10 |
| Additive A | 0.5 ptb | 0 | 10 |
| Additive B | 0.5 ptb | | |

From a review of Table VIII, it can be seen that both Additive A and Additive B were effective. It also can be seen that Additive A and the same total concentration of a mixture of Additive A and Additive B were more effective than Additive B alone.

EXAMPLE V

A sample comprising 100 ml portions of gasoline containing 10 ptb of HECO and a total of 1 ptb of Additive A, Additive B or a combination of Additive A and Additive B was tested with another typical gasoline contaminant, refinery process water bottoms having a pH of 10. A sample containing 90 wt. % of this fuel and 10 wt. % of the process water bottoms was utilized. The Multiple Contact Emulsion Test described in Comparative Example V was utilized with one modification. The sample was shaken at 1½ hour intervals rather than 24 hour intervals. Thus, this procedure is more severe than the test method of Comparative Example V. The results of this test are set forth in Table IX below.

TABLE IX

| MODIFIED EMULSION TEST RESULTS | | | |
|---|---|---|---|
| DEMULSIFIER DESCRIPTION | CONCEN-TRATION | WORST RATING | NUMBER OF GASOLINE TREATS |
| Additive A | 1 ptb | 7 | 10 |
| Additive B | 1 ptb | 2 | 10 |
| Additive A | 0.5 ptb | 2 | 10 |
| Additive B | 0.5 ptb | | |

From this table it can be seen that Additive B and a mixture of Additive A and Additive B were more effective than Additive A alone.

Demulsifier Additive A was thus found to be more effective than Additive B with neutral water, while Additive B was much more effective than Additive A when the water was basic. The combination of these additives is particularly preferred, since it was highly effective in both neutral and basic conditions.

Where the presently described invention is used as a gasoline additive, the additive package may be added to the gasoline at any point after the gasoline has been refined, i.e., the additive package can be added at the refinery or in the distribution system. To assure a relatively constant concentration of the additive package in the gasoline and to assure that none of the additives precipitate from the additive package, diluent solvents typically are combined with the additive package to produce an additive concentrate which is metered into the fuel.

The amine oxide typically has water present from the manufacturing process. While it is possible to remove most of the water, removal of the water to relatively low levels, i.e. a ratio of about 0.02 to about 0.04 of water to amine oxide, adds complexity to the manufacturing process. Therefore, the amine oxide is commercially available as a solution which has the following composition:

| Additive | Approximate Concentration, Wt. % |
|---|---|
| HECO | 47–49 |
| isopropyl alcohol | 45 |
| water | 6–8 |

To provide an additive concentrate which is pumpable and which does not precipitate even in winter conditions, the concentrate preferably should have a cloud point below about −20° F. and a pour point of less than −40° F.

Typically, the additive package is diluted in the range of about 1:1 to about 10:1 with diluent solvent, preferably about 5:1 to facilitate metering and to provide a concentrate having the desired cloud and pour points.

COMPARATIVE EXAMPLE VI

In this test, the additive package was diluted about 4.9:1 with a diluent which comprised about 90 wt. % xylene and 10 wt. % isopropanol. The resulting concentrate had the following composition:

| Additive | Approximate Concentration, Wt. % |
|---|---|
| Amine Oxide | 8.00 |
| Xylene | 73.50 |
| isopropyl alcohol | 15.84 |
| water | 1.00 |
| Demulsifier A | 0.83 |
| Demulsifier B | 0.83 |
| | 100.00 |

Twenty-five ml. of this additive concentrate were mixed with 25 ml. of gasoline and 10 ml. of refinery water bottoms in an 8 inch centrifuge tube with a narrow tip to simulate the conditions which could occur in the field before the additive concentrate is completely mixed with the gasoline. An excess of water was included for illustrative purposes as set forth below.

The tube was placed in an ultrasonic bath at room temperature and subjected to ultrasonic frequencies for about five minutes to cause intimate mixing. After removal from the ultrasonic bath and centrifugation to facilitate separation, it was noted that three phases had formed, two organic phases and a water phase. Formation of two organic phases is not desirable, since this was found to result in uneven distribution of the HECO between the layers. In addition, the second organic layer which has a much higher HECO concentration, tends to adhere to the surfaces, resulting in additive loss and potential contamination of subsequent hydrocarbon products that might contact these surfaces.

EXAMPLE VI

In this Example, the same additive package was used as was used in Comparative Example VI. The additive package again was diluted with about 4.9 parts solvent. However, in this Example the isopropanol in the diluent solvent was replaced with an equal weight of $C_8$ oxo alcohol. The concentrate had the following composition:

| Additive | Approximate Concentration, Wt. % |
|---|---|
| Amine Oxide | 8.00 |
| Xylene | 73.50 |
| $C_8$ oxo alcohol | 8.17 |
| isopropyl alcohol | 7.67 |
| water | 1.00 |
| Demulsifier A | 0.83 |
| Demulsifier B | 0.83 |
| | 100.00 |

Twenty-five ml. of this additive concentrate were mixed with 25 ml. of gasoline and 10 ml. of refinery water bottoms and intimately mixed in an ultrasonic bath as described in Comparative Example VI. After intimate mixing and centrifugation to facilitate separation, it was noted that only two layers, an organic layer and a water layer were formed.

From this Example it can be seen that the replacement of at least a portion of the isopropanol by a higher molecular weight alcohol, preferably a $C_4$–$C_{12}$ alcohol, more preferably an oxo alcohol and most preferably a $C_8$ oxo alcohol, prevented the formation of two organic layers. As used herein the term "oxo alcohol" refers to one or more branched chain aliphatic alcohols prepared by the reaction of carbon monoxide and olefins followed by hydrogenation of the resulting aldehydes.

A series of tests also were run utilizing different solvents to determine the cloud point of the resulting additive concentrates. Those tests generally were conducted in accordance with ASTM test method D2500, the disclosure of which is incorporated herein by reference. These results are presented in Table X.

From a review of Table X, it can be seen that the combination of a solvent system comprising xylene, isopropyl alcohol and $C_8$ oxo alcohol produces an additive concentrate which has a cloud point below about −46° F. for the point tested. By comparison, use of a solvent system comprising only xylene and $C_8$ oxo alcohol produced a system which had acceptable cloud points only over a very narrow concentration range. Therefore, the use of a mixed alcohol solvent system is desirable to produce a concentrate having good low temperature properties without the tendency to form a second organic layer.

Multiple Contact Emulsion Tests were conducted in a manner similar to that set forth in Comparative Example V for gasoline samples. The tests were run on both unleaded regular grade gasoline and unleaded premium grade gasoline containing 10 ptb HECO and 0.5 ptb each of Demulsifiers A and B, to which 10 wt. % terminal water bottoms having a pH of about 7 and 8, respectively, had been added as previously described. The samples were shaken for 10 minutes at 180 cycles per minute. The bottles then were permitted to stand for the times indicated and rated. As shown by the data in Table XI, the replacement of the isopropanol by the combination of isopropanol with $C_8$ oxo alcohol did not adversely affect the effectiveness of the demulsifier package. Thus, a concentrate including a solvent system comprising isopropanol and $C_8$ oxo alcohol has acceptable demulsifying properties and an improved cloud point relative to a solvent system comprising $C_8$ oxo alcohol alone, when significant quantities of water are present. As previously noted, such a solvent system also does not promote the formation of multiple organic layers.

TABLE XI

MULTIPLE CONTACT EMULSION TEST

| Fuel | Time (Hrs.) | Emulsion Rating: Isopropanol Alone | Emulsion Rating: Isopropanol + $C_8$ oxo Alcohol |
|---|---|---|---|
| Unleaded Regular | 1 | 2 | 2 |
| | 4 | 2 | 2 |
| | 24 | 2 | 2 |
| Unleaded Premium | 1 | 3 | 2–3 |
| | 4 | 2–3 | 2–3 |
| | 24 | 2 | 2 |

What is claimed is:

1. A method for reducing and/or preventing fouling in a multiport, electronically controlled fuel injection system for an internal combustion engine, said method comprising delivering to said fuel injection system a fuel composition comprising:

A. gasoline;

B. an antifouling agent having the formula

TABLE X

CLOUD POINT DETERMINATIONS

| Additive Concentrate Composition, Wt. %: Solvent Composition: Xylene | Isopropanol | $C_8$ Oxo Alcohol | Amine Oxide | Water | Demulsifier | Cloud Point, °F. |
|---|---|---|---|---|---|---|
| 81.67 | 7.67 | 0 | 8.00 | 1.00 | 1.66 | −36 |
| 73.50 | 7.67 | 8.17 | 8.00 | 1.00 | 1.66 | <−46 |
| 73.50 | 15.84 | 0 | 8.00 | 1.00 | 1.66 | <−50 |
| 81.67 | 0 | 7.67 | 8.00 | 1.00 | 1.66 | Cloudy at room temperature |
| 79.22 | 0 | 10.12 | 8.00 | 1.00 | 1.66 | +8 |
| 77.59 | 0 | 11.75 | 8.00 | 1.00 | 1.66 | −18 |
| 75.95 | 0 | 13.39 | 8.00 | 1.00 | 1.66 | −30 |
| 73.50 | 0 | 15.84 | 8.00 | 1.00 | 1.66 | Cloudy at room temperature |

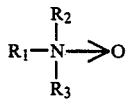

wherein: $R_1$ is $C_6$ to $C_{24}$ alkyl, aryl, cycloaliphatic, heterocyclic, substituted alkyl or substituted aryl; $R_2$ and $R_3$ independently are $C_1$ to $C_{24}$ alkyl, aryl, substituted alkyl or aryl, cycloaliphatic or heterocyclic; and C. an effective amount of a demulsifier selected from the group consisting of:
   i. a fatty acid alkylamine reaction product;
   ii. a solution of oxyalkylated alkylphenol formaldehyde resins and polyglycols; and
   iii. mixtures of i and ii.

2. The method of claim 1 wherein $R_1$ is $C_6$ to $C_{20}$ alkyl, or alkylated aryl; and $R_2$ and $R_3$ independently are hydroxy substituted $C_1$ to $C_{12}$ alkyl.

3. The method of claim 2 wherein $R_1$ comprises $C_8$ to $C_{18}$ substituents.

4. The method of claim 3 wherein the antifouling agent is selected from the group consisting of bis(2-hydroxy ethyl) cocoamine oxide, bis(2-hydroxy ethyl) tallow amine oxide, bis (2-hydroxy ethyl) stearylamine oxide, dimethylcocoamine oxide, dimethyl hydrogenated tallow amine oxide, dimethylhexadecylamine oxide and mixtures thereof.

5. The method of claim 4 wherein the antifouling agent is bis(2-hydroxy ethyl) cocoamine oxide.

6. The method of claim 5 wherein the demulsifier comprises:

A. a fatty acid alkylamine reaction product; and,

B. a solution of oxyalkylated alkylphenol formaldehyde resins and polyglycols.

7. A fuel composition for reducing and/or preventing fouling in a multiport, electronically controlled fuel injection system for an internal combustion engine said fuel composition comprising:

A. gasoline;

B. an antifouling agent having the formula

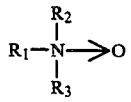

wherein; $R_1$ is $C_6$ to $C_{24}$ alkyl, aryl, cycloaliphatic, heterocyclic, substituted alkyl or substituted aryl; $R_2$ and $R_3$ independently are $C_1$ to $C_{24}$ alkyl, aryl, substituted alkyl or aryl, cycloaliphatic or heterocyclic, said antifouling agent being present in an amount sufficient to reduce and/or eliminate fuel injector fouling; and C. an effective amount of a demulsifier selected from the group consisting of:
   i. a fatty acid alkylamine reaction product;
   ii. a solution of oxyallkylated alkylphenol formaldehyde resins and polyglycols; and
   iii. mixtures of i and ii.

8. The fuel composition of claim 7 wherein $R_1$ comprises $C_8$ to $C_{18}$ substituents.

9. The fuel composition of claim 8 wherein the additive is selected from the group consisting of bis(2-hydroxy ethyl) cocoamine oxide, bis(2-hydroxy ethyl) tallow amine oxide, bis(2-hydroxy ethyl) stearylamine oxide, dimethylcocoamine oxide, dimethyl hydrogenated tallow amine oxide, dimethylhexadecylamine oxide and mixtures thereof.

10. The fuel composition of claim 9 wherein the antifouling agent is bis(2-hydroxy ethyl) cocoamine oxide.

11. The fuel composition of claim 10 wherein the fuel comprises unleaded gasoline.

12. The fuel composition of claim 11 wherein the demulsifier comprises:

A. a fatty acid alkylamine reaction product; and

B. a solution of oxyalkylated alkylphenol formaldehyde resins and polyglycols.

13. The fuel composition of claim 12 wherein the bis(2-hydroxy ethyl) cocoamine oxide concentration ranges between about 2 and about 200 ppm.

14. A fuel additive concentrate for internal combustion engines, said additive comprising:

A. about 5 to about 50 wt. % bis(2-hydroxy ethyl) cocoamine oxide;

B. about 0.25 to about 10 wt. % fatty acid alkylamine reaction product; and,

C. about 0.25 to about 10 wt. % oxyalkylated alkylphenol formaldehyde resins and polyglycols;

D. about 40 to about 95 wt. % solvent.

15. The fuel additive concentrate of claim 14 wherein the solvent comprises alkyl aromatic hydrocarbon and an alcohol selected from the group consisting of isopropanol, $C_4$ to $C_{12}$ alcohols, and mixtures thereof.

16. The fuel additive concentrate of claim wherein the alcohol comprises a $C_8$ alcohol.

17. A fuel additive concentrate for internal combustion engines, said additive comprising:

A. about 5 to about 50 wt. % bis(2-hydroxy ethyl) cocoamine oxide;

B. about 0.25 to about 10 wt. % of a demulsifying agent selected from the group consisting of:
   i. a fatty acid alkylamine reaction product;
   ii. a solution of oxyalkylated alkylphenol formaldehyde resins and polyglycols; and
   iii. mixtures of i and ii; and, C. about 40 to about 95 wt. % of a solvent comprising:
   i. xylene; and
   ii. a $C_4$–$C_{12}$ alcohol.

18. A fuel composition for reducing and/or preventing fouling in a multiport electronically controlled fuel injection system for an internal combustion engine, said fuel composition comprising:

A. about 20 to about 60 ppm bis(2-hydroxy ethyl) cocoamine oxide;

B. about 0.5 to about 4 ppm fatty acid alkylamine reaction product; and,

C. about 0.5 to about 4 ppm oxyalkylated alkylphenol formaldehyde resins and polyglycols.

* * * * *